US012303960B2

(12) United States Patent
Lu et al.

(10) Patent No.: US 12,303,960 B2
(45) Date of Patent: May 20, 2025

(54) PROCESSING APPARATUS, CONTROL METHOD FOR PROCESSING APPARATUS AND HEAT EXCHANGER

(71) Applicant: ZHEJIANG SANHUA AUTOMOTIVE COMPONENTS CO., LTD., Zhejiang (CN)

(72) Inventors: Guojian Lu, Zhejiang (CN); Lintong Ding, Zhejiang (CN); Jianwei Zhang, Zhejiang (CN)

(73) Assignee: ZHEJIANG SANHUA AUTOMOTIVE COMPONENTS CO., LTD., Zhejiang (CN)

( * ) Notice: Subject to any disclaimer, the term of this patent is extended or adjusted under 35 U.S.C. 154(b) by 173 days.

(21) Appl. No.: 18/000,119

(22) PCT Filed: May 20, 2021

(86) PCT No.: PCT/CN2021/094796
§ 371 (c)(1),
(2) Date: Nov. 28, 2022

(87) PCT Pub. No.: WO2021/238756
PCT Pub. Date: Dec. 2, 2021

(65) Prior Publication Data

US 2023/0191470 A1 Jun. 22, 2023

(30) Foreign Application Priority Data

May 28, 2020 (CN) ..... 202010470084.0
May 28, 2020 (CN) ..... 202020942710.7

(51) Int. Cl.
*B21D 28/14* (2006.01)
*B21D 53/04* (2006.01)
*F28F 3/02* (2006.01)

(52) U.S. Cl.
CPC ..... *B21D 28/14* (2013.01); *B21D 53/04* (2013.01); *F28F 3/02* (2013.01)

(58) Field of Classification Search
CPC ..... B21D 28/02; B21D 28/14; B21D 28/34; B21D 53/04; B26F 1/14
See application file for complete search history.

(56) References Cited

U.S. PATENT DOCUMENTS 4,956,989 A 9/1990 Nakajima
2012/0192688 A1* 8/2012 Allen ..... B21D 28/34 83/13

(Continued)

FOREIGN PATENT DOCUMENTS

CN 105855360 A 8/2016
CN 106918255 A 7/2017

(Continued)

OTHER PUBLICATIONS

International Search Report, from the International Searching Authority, mailed to International Application No. PCT/CN2021/094796 on Aug. 18, 2021, 8 pages.

(Continued)

*Primary Examiner* — Teresa M Ekiert
(74) *Attorney, Agent, or Firm* — Hunton Andrews Kurth LLP

(57) ABSTRACT

A processing apparatus includes an upper die assembly, a lower die assembly and a driving mechanism. The upper die assembly includes a first cutter. The lower die assembly includes a second cutter and a lower die plate. The lower die plate has an upper end portion facing the upper die assembly. The second cutter includes a second cutting edge portion higher than the upper end portion. Further provided is a control method for the processing apparatus, and a heat exchanger.

10 Claims, 8 Drawing Sheets

(56) References Cited

U.S. PATENT DOCUMENTS

| | | | | |
|---|---|---|---|---|
| 2017/0080475 | A1* | 3/2017 | Matsuno | B21D 28/02 |
| 2017/0136518 | A1* | 5/2017 | Moriya | B21D 28/14 |

FOREIGN PATENT DOCUMENTS

| | | | |
|---|---|---|---|
| CN | 107983833 | A | 5/2018 |
| CN | 110657692 | A | 1/2020 |
| CN | 111692741 | A | 9/2020 |
| CN | 212673913 | U | 3/2021 |
| CN | 212976409 | U | 4/2021 |
| EP | 0734799 | A2 | 10/1996 |
| JP | S62151028 | A | 7/1987 |
| JP | S62292398 | A | 12/1987 |
| JP | H08332529 | A | 12/1996 |
| JP | H11207418 | A | 8/1999 |
| JP | 2000288668 | A | 10/2000 |
| JP | 2003126927 | A | 5/2003 |
| JP | 2006272398 | A | 10/2006 |
| KR | 20130142351 | A | 12/2013 |

OTHER PUBLICATIONS

Supplemental European Search Report issued in corresponding EP 21811774 on Jul. 17, 2024 (15 pages).
Extended European Search Report issued in corresponding EP 21811774 on Nov. 21, 2024 (17 pages).

* cited by examiner

PROCESSING APPARATUS, CONTROL METHOD FOR PROCESSING APPARATUS AND HEAT EXCHANGER

CROSS-REFERENCE TO RELATED APPLICATION(S)

This is a national stage application filed under 37 U.S.C. § 371 based on International Patent Application No. PCT/CN2021/094796, filed May 20, 2021, which claims priority to Chinese Patent Applications No. 202010470084.0 and No. 202020942710.7 filed with the China National Intellectual Property Administration (CNIPA) on May 28, 2020, the disclosures of which are incorporated herein by reference in their entireties.

TECHNICAL FIELD

The present application relates to the field of processing and production of heat exchange devices, for example, to a processing apparatus, a control method for the processing apparatus, and a heat exchanger.

BACKGROUND

Fins are basic elements of a plate fin heat exchanger, and the heat exchange process is mainly completed by the fins. In production, a fin former machine is a professional equipment for continuously processing aluminum foil in rolls into the fins. After the fins are punched, the fins need to be cut according to the designed dimension, and the cut fins requires deburring and other processes. If the fins have poor flatness, the subsequent assembly of the fins, the product quality and performance of the heat exchanger will be affected.

The fins are the primary component of the heat exchanger, and have the function of increasing the heat exchange area and improving the heat exchange efficiency. The fins can be die punched during which the whole raw material is cut into the fin shape required by the customer by up and down cutting of upper and lower slitters of a transverse cutting sub-die. If the fins have poor flatness, the product performance of the heat exchanger will be affected.

SUMMARY

Embodiments of the present disclosure aim to provide a processing apparatus, a control method for the processing apparatus, and a heat exchanger. Fins cut by the processing apparatus have relatively high flatness.

The present application provides a processing apparatus. The processing apparatus includes an upper die assembly, a lower die assembly and a driving mechanism.

The upper die assembly includes a first cutter. The first cutter includes a first cutting edge portion.

The lower die assembly is disposed opposite to the upper die assembly. The lower die assembly includes a second cutter and a lower die plate. The lower die plate has an upper end portion facing the upper die assembly. The second cutter is fixedly connected to the upper end portion and the second cutter includes a second cutting edge portion higher than the upper end portion. The distance between the second cutting edge portion and the upper end portion is denoted as H. The value range of H is 0.1 mm≤H≤0.3 mm.

The driving mechanism is configured to enable the upper die assembly to move with respect to the lower die assembly so that the first cutting edge portion is interleaved with the second cutting edge portion.

The present disclosure further provides a control method for a processing apparatus. The processing apparatus includes an upper die assembly, a lower die assembly and a driving mechanism. The upper die assembly further includes an upper die plate and a first cutter. The first cutter includes a first cutting edge portion. One end of the first cutter away from the first cutting edge portion is connected to the upper die plate. The upper die assembly includes a stripper plate and a first elastic element. The stripper plate is formed on one side of the upper die plate close to a second cutter. One end of the first elastic element is connected to the stripper plate, and another end of the first elastic element is connected to the upper die plate. A first via is formed on the stripper plate in a direction in which the first cutter moves. The lower die assembly is disposed opposite to the upper die assembly. The lower die assembly includes the second cutter and a lower die plate. The lower die plate has an upper end facing the upper die assembly. The second cutter is fixed to the upper end portion. The second cutter includes a second cutting edge portion higher than the upper end portion in a vertical direction. The driving mechanism includes a first driver.

The control method for the processing apparatus includes the steps described below. A material is fed to the upper end portion and the first driver is activated. The first driver drives the upper die plate to move downward, the first cutter moves downward along with the upper die plate and the stripper plate moves downward synchronously. When the stripper plate moves to be in contact with the material, the lower die plate continues moving downward under the action of the first driver, the first elastic element is compressed, the first cutting edge portion starts to move downward along the first via, after the first cutting edge portion moves a preset distance, the first cutting edge portion is exposed out of the first via, and when the first cutting edge portion moves to a bottom dead position, the first cutting edge portion is interleaved with the second cutting edge portion so as to complete cutting the material.

After the material cutting ends, the first driver drives the upper die plate to move upward, the upper die plate drives the first cutter to move upward, the first elastic element is stretched, the stripper plate is stationary with respect to the upper end portion under an elastic force of the first elastic element, when the first cutting edge portion moves upward between an upper port of the first via and a lower port of the first via, and the first driver drives the stripper plate to moves upward.

The present disclosure further provides a heat exchanger. The heat exchanger includes a core. The core includes a first plate and a second plate disposed in stack. A first inter-plate channel is formed between the first plate and the second plate adjacent to the first plate. The core further includes fins. The fins are disposed between the first plate and the second plate. The fins are located in the first inter-plate channel. Each fin includes multiple protrusion portions and multiple connection portions. Each connection portion connects two adjacent ones of the multiple protrusion portions. Each protrusion portion includes a first sidewall, a top wall, and a second sidewall. One end of the first sidewall is connected to one end of the top wall. One end of the second sidewall is connected to another end of the top wall. Another end of the first sidewall is connected to one connection portion of the multiple connection portions adjacent to the each protrusion portion, and another end of the second sidewall is connected to another connection portion of the multiple connection portions adjacent to the each protrusion portion. Each fin further includes a first edge portion. The first edge portion is disposed in one of manners described below.

The first edge portion is connected to the second sidewall. The first edge portion or an end portion of the first edge portion away from the second sidewall is tilted over the first plate.

The first edge portion is connected to the first sidewall. The first edge portion or an end portion of the first edge portion away from the first sidewall is tilted over the second plate.

REFERENCE LIST

Figure 1:
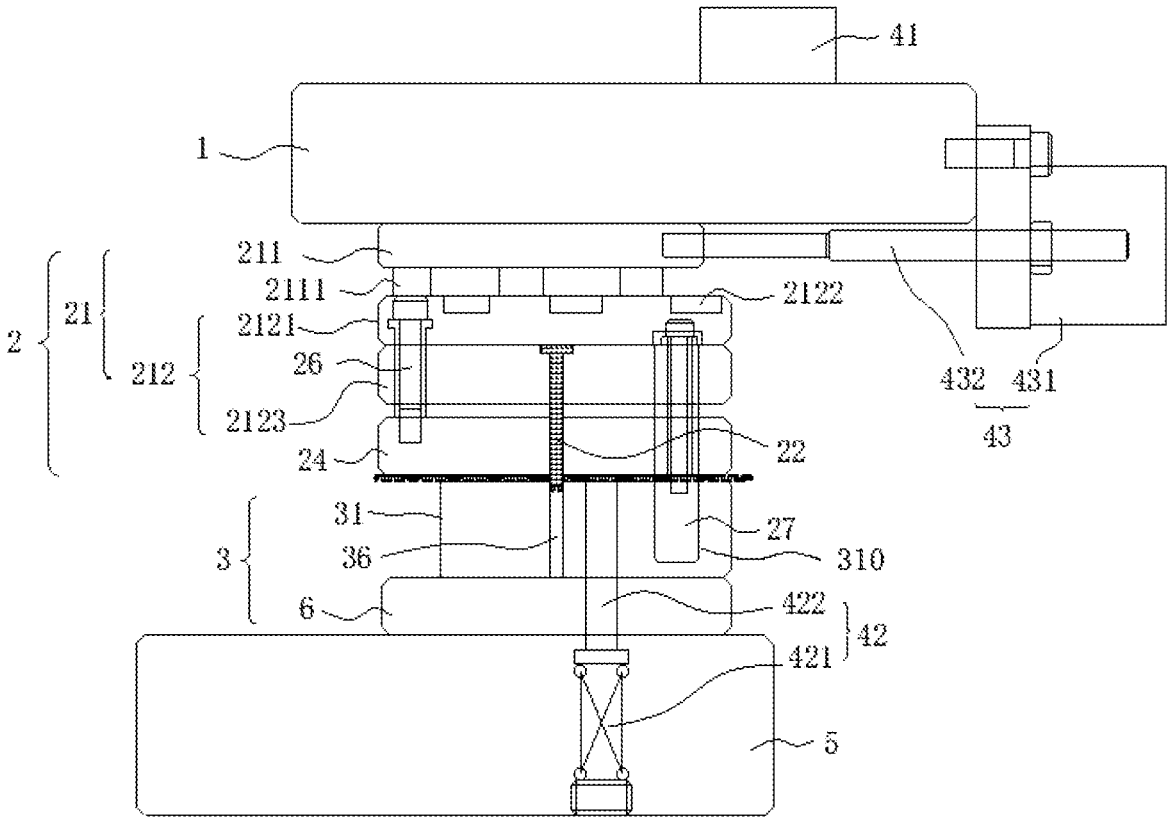
FIG. 1 is a view illustrating a processing apparatus according to an embodiment of the present application.

| | |
|---|---|
| 1 | upper die plate mounting table |
| 2 | upper die assembly |
| 21 | upper die plate |
| 211 | first upper die plate |
| 2111 | protrusion |
| 212 | second upper die plate |
| 2121 | first sub-die-plate |
| 2122 | recess |
| 2123 | second sub-die-plate |

-continued

| | |
|---|---|
| 21230 | step recess |
| 22 | first cutter |
| 221 | first cutting edge portion |
| 222 | step portion |
| 24 | stripper plate |
| 241 | first stud hole |
| 242 | first stop |
| 243 | first via |
| 25 | first elastic element |
| 26 | first stud |
| 261 | second stop |
| 27 | second stud |
| 3 | lower die assembly |
| 31 | lower die plate |
| 311 | lower die plate body |
| 312 | mounting base |
| 313 | upper end portion |
| 310 | positioning hole |
| 32 | second cutter |
| 321 | first slope portion |
| 322 | second cutting edge portion |
| 323 | vertical portion |
| 33 | fourth cutter |
| 331 | second slope portion |
| 332 | fourth cutting edge portion |
| 34 | cutting recess |
| 35 | positioning protrusion |
| 36 | blanking channel |
| 37 | first sidewall portion |
| 38 | second sidewall portion |
| 41 | first sub-driver |
| 42 | second sub-driver |
| 421 | second elastic element |
| 422 | drive arm |
| 43 | second driver |
| 431 | driver body |
| 432 | drive rod |
| 5 | lower die plate mounting table |
| 6 | pad |
| 71 | molding recess |
| 72 | edge portion |
| 10 | first plate |
| 110 | first planar portion |
| 120 | corner hole |
| 130 | flanging |
| 20 | fin |
| 2110 | first sidewall |
| 2120 | top wall |
| 213 | second sidewall |
| 220 | connection portion |
| 230 | first edge portion |
| 2301 | second edge portion |
| 2302 | third edge portion |
| 240 | flow recess |
| 2401 | first flow recess |
| 2411 | sidewall of first flow recess |
| 2412 | opening of first flow recess |
| 2402 | second flow recess |
| 2413 | sidewall of second flow recess |
| 2414 | opening of second flow recess |
| 250 | flow hole |
| 2501 | inner extension portion |
| 30 | second plate |
| 3001 | second planar portion |

DETAILED DESCRIPTION

For a better understanding of embodiments of the present application by those skilled in the art, the embodiments will be described in conjunction with the drawings. In the present application, terms such as "upper, lower, left, right" are established based on positional relationships shown in the drawings, and according to different drawings, the corresponding positional relationships may also be changed. Moreover, relational terms such as "first" and "second" are only used for distinguishing one from another element having the same name and any such actual relationship or order are not necessarily required or implied between these elements.

Figure 4:
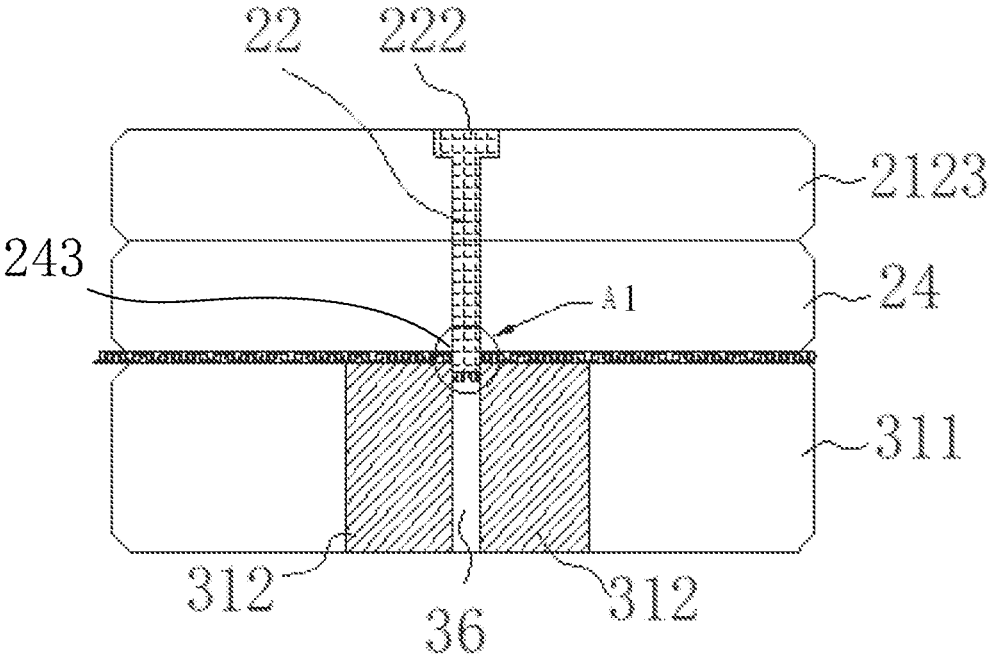
FIG. 4 is a view illustrating the structure of an upper die assembly and a lower die assembly in a die closing state according to an embodiment of the present application.
Figure 6:
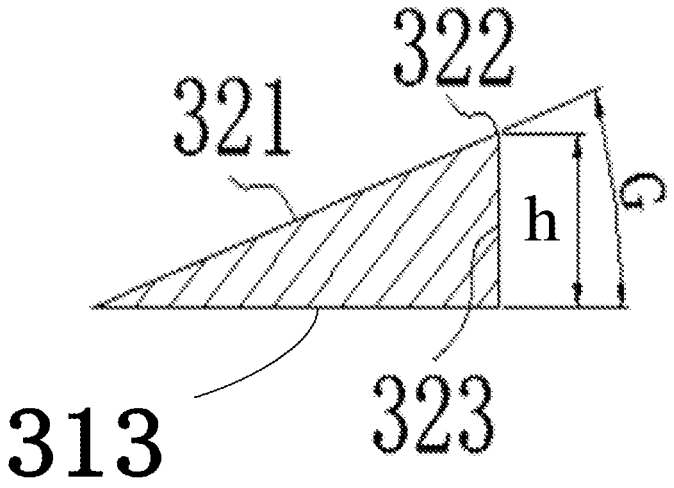
FIG. 6 is a sectional view of a second cutter according to an embodiment of the present application.

Referring to FIGS. 1, 4 and 6, the present application provides a processing apparatus. The processing apparatus includes an upper die assembly 2, a lower die assembly 3 and a driving mechanism. The upper die assembly 2 includes a first cutter 22 and an upper die plate 21. The first cutter 22 includes a first cutting edge portion 221. One end of the first cutter 22 away from the first cutting edge portion 221 is connected to the upper die plate 21.

The lower die assembly 3 is opposite to the upper die assembly 2. The lower die assembly 3 includes a second cutter 32 and a lower die plate 31. The lower die plate 31 has an upper end portion 313 facing the upper die assembly 2. The upper end portion 313 is configured for placing a fin to be cut. The second cutter 32 is fixedly connected to the upper end portion 313. The second cutter 32 is fixed to the upper end portion 313 and includes a second cutting edge portion 322 higher than the upper end portion 313. The distance between the second cutting edge portion 322 and the upper end portion 313 is denoted as H, and the value range of H is 0.1 mm≤H≤0.3 mm.

Referring to FIGS. 1, 4 and 6, a vertical direction refers to an up and down direction in FIGS. 1, 4 and 6. That is, the direction along which the upper die assembly 2 faces the lower die assembly 3 is considered as a downward direction, and the direction along which the lower die assembly 3 faces the upper die assembly 2 is considered as an upward direction.

The driving mechanism may drive the upper die assembly 2 and the lower die assembly 3 to be closed. That is, the upper die assembly 2 moves with respect to the lower die assembly 3 so that the first cutter 22 moves toward the second cutter 32, and the first cutting edge portion 221 is interleaved with the second cutting edge portion 322. Apparently, the driving mechanism may also drive the first cutter 22 or the second cutter 32 to move up and down so that the first cutting edge portion 221 is interleaved with the second cutting edge portion 322. Therefore, a cutting force may be generated on the fin placed on the upper end portion 313 and cut the fin.

When the processing apparatus provided by the present application cuts the fin, the fin to be cut is placed on the upper end portion 313, the driving mechanism is able to drive the upper die assembly 2 and the lower die assembly 3 to be closed. That is, the upper die assembly 2 is caused to move with respect to the lower die assembly 3 so that the first cutter 22 moves toward the second cutter 32 and the first cutting edge portion 221 is interleaved with the second cutting edge portion 322. After the fin to be cut is cut, since the second cutting edge portion 322 is higher than the upper end portion 313, the cut or cutting surface of the fin is higher than the upper end portion 313, and the fin is located at the upper end portion 313 so that the cut or cutting surface of the fin is higher than the lower surface of the fin in the vertical direction. The lower surface of the fin refers to a plane in which a part of the fin in contact with the upper end portion 313 is located. In this manner, the burrs protruding from the lower surface of the fin and generated during the cutting process, and the effect of on the flatness of the lower surface of the fin are reduced, so that the lower surface of the fin can be better attached to the plate of a heat exchanger during the mounting process of the fin, improving the welding quality of the fin and the plate of the heat exchanger, and improving the heat exchange efficiency and the service life of the heat exchanger.

Figure 2:
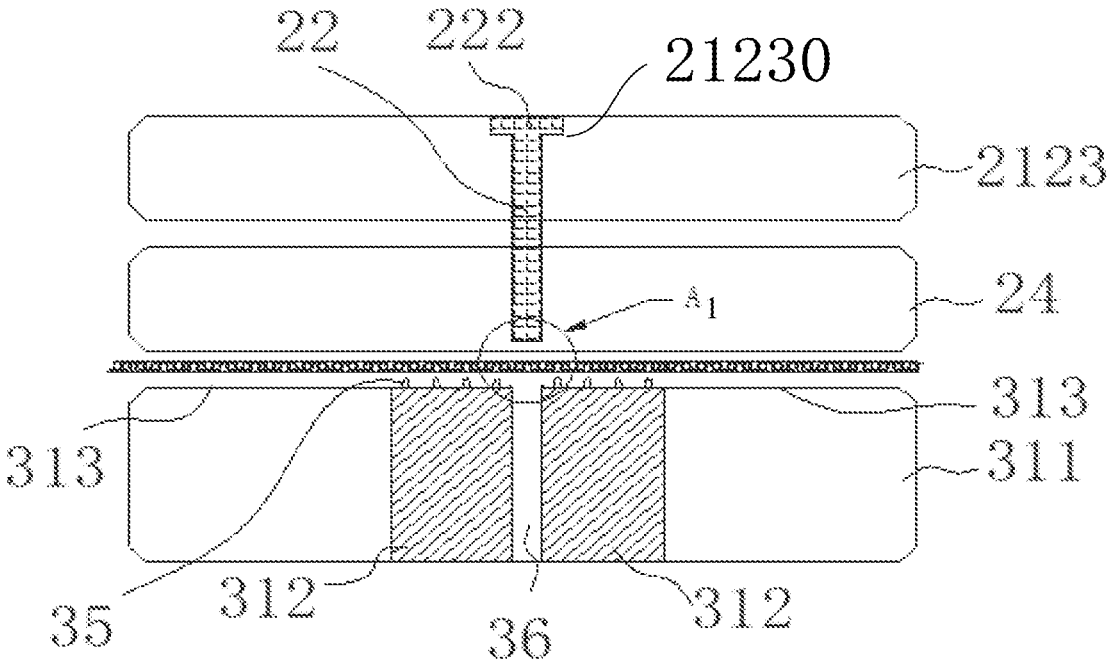
FIG. 2 is a view illustrating the structure of an upper die assembly and a lower die assembly in a die opening state according to an embodiment of the present application.
Figure 3:
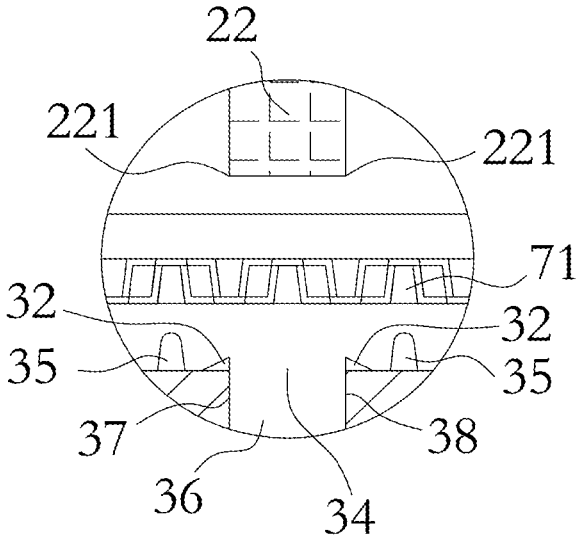
FIG. 3 is a partial enlarged view of part A1 of FIG. 2.

Referring to FIGS. 2, 3 and 6, the second cutter 32 further has a first slope portion 321 in a direction facing the upper die assembly 2. One end of the first slope portion 321 is connected to the upper end portion 313, and another end of the first slope portion 321 is connected to the second cutting edge portion 322. In a direction facing the second cutting edge portion 322, the vertical distance between the first slope portion 321 and the upper end portion 313 gradually increases. The value range of the included angle G between the first slope portion 321 and the upper end portion 313 is 15°≤G≤20°. When the raw material of the fin is cut, the fin is not excessively deformed and has less burrs.

Referring to FIGS. 2, 3, 6, the second cutter 32 has a vertical portion 323. The vertical portion 323 is a wall portion of the second cutter 32 that is substantially perpendicular to the lower die plate 31. One end of the vertical portion 323 is connected to the upper end portion 313, and another end of the vertical portion 323 is connected to the second cutting edge portion 322. In FIG. 3, for convenience of observation and labelling, the first cutter 22 is magnified for illustration. Referring to FIG. 6, one sectional shape of the second cutter 32 is a right triangle, the number of second cutters 32 is two, the vertical portion 323 of one of the second cutters 32 is disposed opposite to the vertical portion 323 of the other of the second cutters 32, and the first cutter 22 includes two first cutting edge portions 221. The driving mechanism is able to drive the first cutter 22 to move up and down so that one of the two first cutting edge portions 221 is interleaved with one of second cutting edge portions 322, and correspondingly, the other of the two first cutting edge portions 221 is interleaved with the other of the second cutting edge portions 322.

Referring to FIGS. 2, 3, 6, a cutting recess 34 is formed between the two vertical portions 323. When the upper die assembly 2 and the lower die assembly 3 are closed, the distance between a wall portion parallel to a vertical wall of a part of the first cutter 22 located within the cutting recess 34, and the vertical portion 323 of the first cutter 22 or the second cutter 32 is 5% to 8% of the aluminum foil thickness, improving the flatness of the fin cut, and reducing the generation of the burrs. The length of the first cutting edge portion 221 and the length of the second cutting edge portion 322 are both larger than the width of the fin. An upper trimming blade may reciprocate within the cutting recess 34 under the drive of the driving mechanism. The first cutting edge portion 221 is interleaved with the second cutting edge portion 322 so as to cut the fin. The two second cutters 32 are able to continuous operate when the fin to be cut is cut to a desired length, saving the time and cost.

Referring to FIGS. 2 to 3, the lower die plate 31 includes a lower die plate body 311 and mounting bases 312. The lower die plate body 311 is provided with mounting recesses. Each of the mounting bases 312 is disposed within a respective one of the mounting recesses, and upper surfaces of the mounting bases 312 are flush with notches of the mounting recesses. That is, the upper surfaces of the mounting bases 312 and the upper surface of the lower die plate body 311 are aligned and collectively form an upper end portion 313.

A second cutter 32 is formed on the mounting base 312. The mounting base 312 has a first sidewall portion 37 extending downward from one of the vertical portions 323. The mounting base 312 further has a second sidewall portion 38 extending downward from the other of the vertical portions 323. A blanking channel 36 is formed between the first sidewall portion 37 and the second sidewall portion 38 so that the first cutter 22 is interleaved with the second cutter 32, and the waste material generated by cutting the fin to be cut falls into the blanking channel 36 from the cutting recess 34. The mounting base 312 is provided, so that when the second cutter 32 is damaged, it is convenient to replace the second cutter 32, saving the cost. Moreover, it is convenient for the processing apparatus to adapt the second cutter 32 having different shapes.

Figure 8:
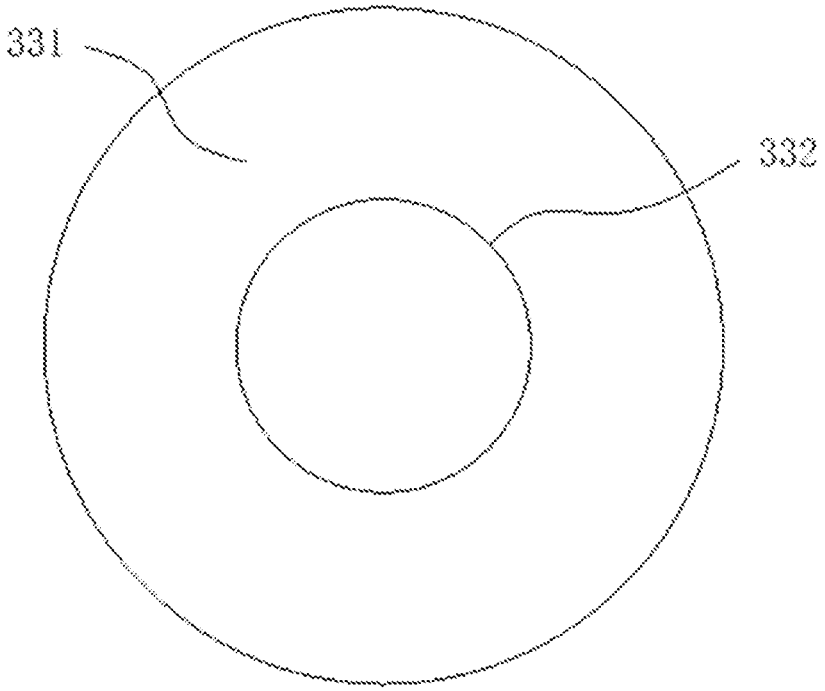
FIG. 8 is a top view of a fourth cutter according to an embodiment of the present application.
Figure 9:
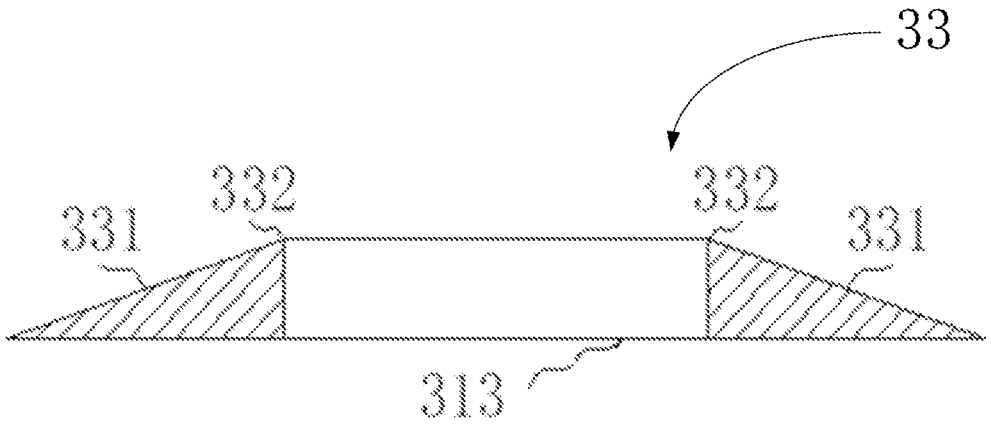
FIG. 9 is a sectional view of a fourth cutter according to an embodiment of the present application.

Referring to FIGS. 8 and 9, the lower die assembly 3 includes a fourth cutter 33. The fourth cutter 33 has a fourth cutting edge portion 332. The fourth cutting edge portion 332 has a larger height in the vertical direction than the upper end portion 313. The fourth cutting edge portion 332 is annular. The fourth cutter 33 further includes a second slope portion 331. One end of the second slope portion 331 is connected to the upper end portion 313, and another end of the second slope portion 331 is connected to the fourth cutting edge portion 332. The vertical distance between the second slope portion 331 and the upper end portion 313 gradually increases in a direction facing the fourth cutting edge portion 332. The driving mechanism is able to drive the upper die assembly 2 to move up and down so that the upper die assembly 2 and the fourth cutting edge portion 332 are interleaved to cut off the fin to be cut, and form a via corresponding to a corner hole of a flow plate of the heat exchanger on the fin. The relative position of the fourth cutter 33 and the second cutter 32 can be set according to specific needs and will not be repeated here again. The fourth cutter 33 which is disposed can cut the via corresponding to the corner hole of the flow plate simultaneously, when the fin to be cut is cut to a desired length, so that the cutting efficiency is improved, and the flatness of the fin is improved, improving the welding quality of the fin and the plate of the heat exchanger, and thus improving the heat exchange efficiency and the service life of the heat exchanger.

Referring to FIG. 3, the fin includes molding recesses 71 and multiple positioning protrusions 71 engaged with the molding recesses 71 are formed on the upper end portion 313. Each of the positioning protrusions 35 may be extended into a respective one of molding recesses 71, preventing the fin from sliding left and right with respect to the upper end portion 313 when the fin to be cut is cut, thereby improving the accuracy of the fin, and the flatness of the cut or cutting surface of the fin.

Figure 10:
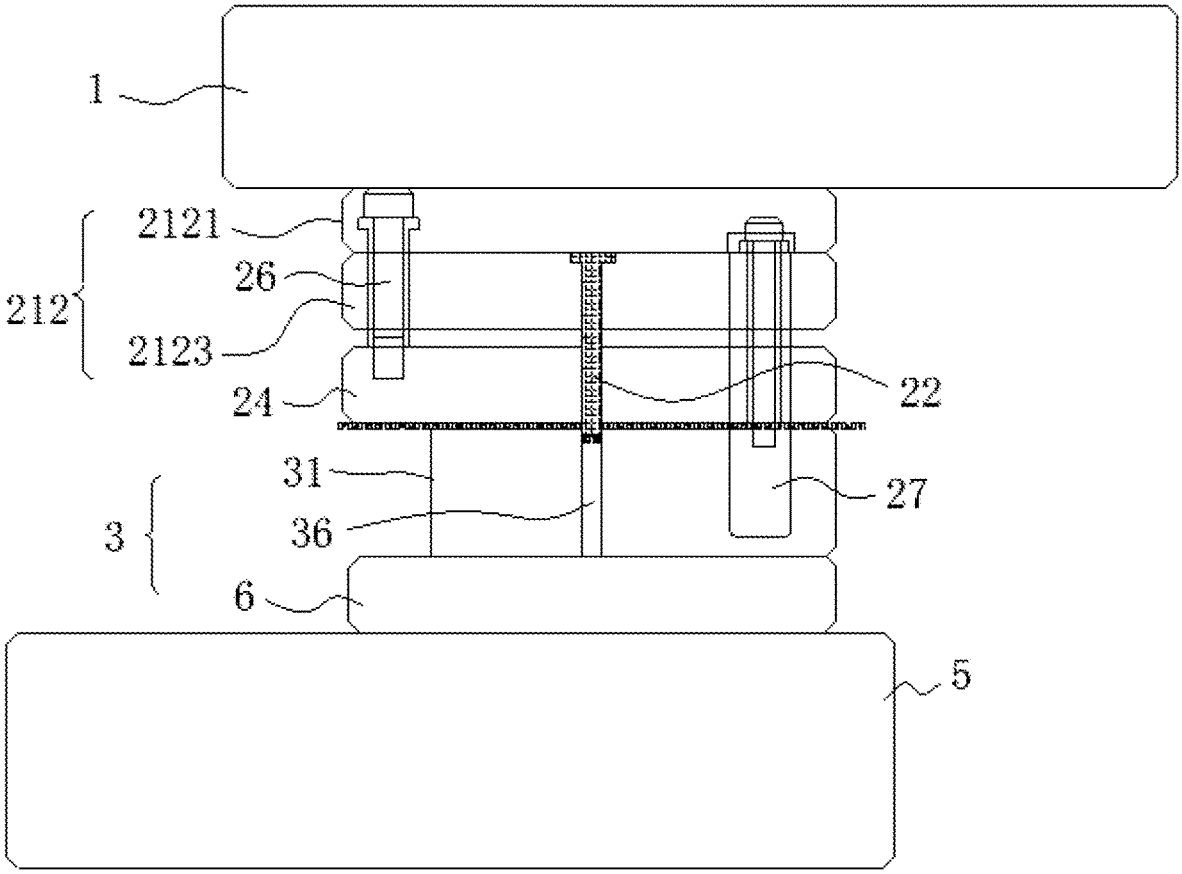
FIG. 10 is another view illustrating a processing apparatus according to an embodiment of the present application.

Referring to FIGS. 1, 2 and 10, the processing apparatus further includes an upper die plate mounting table 1, and the driving mechanism includes a first driver. The first driver is capable of driving the upper die plate mounting table 1 to move up and down. The first driver is a conventional component, such as a hydraulic cylinder or another power component. The upper die assembly 2 further includes an upper die plate 21. The upper die plate 21 includes a second upper die plate 212. The second upper die plate 212 includes a first sub-die-plate 2121 and a second sub-die-plate 2123. The first sub-die-plate 2121 is fixedly connected to the upper die plate mounting table 1. The second sub-die-plate 2123 includes a step recess 21230. A step portion 222 is formed at one end of the first cutter 22 away from the first cutting edge portion 221. The step portion 222 is disposed in the step recess 21230. The first sub-die-plate 2121 and the second sub-die-plate 2123 are connected by a bolt or the like. The first sub-die-plate 2121 is disposed above the second sub-die-plate 2123, and the first sub-die-plate 2121 compresses the step portion 222 so that the first cutter 22 is fixed to the first upper die plate 211 so as to facilitate replacing the first cutter 22.

Figure 11:
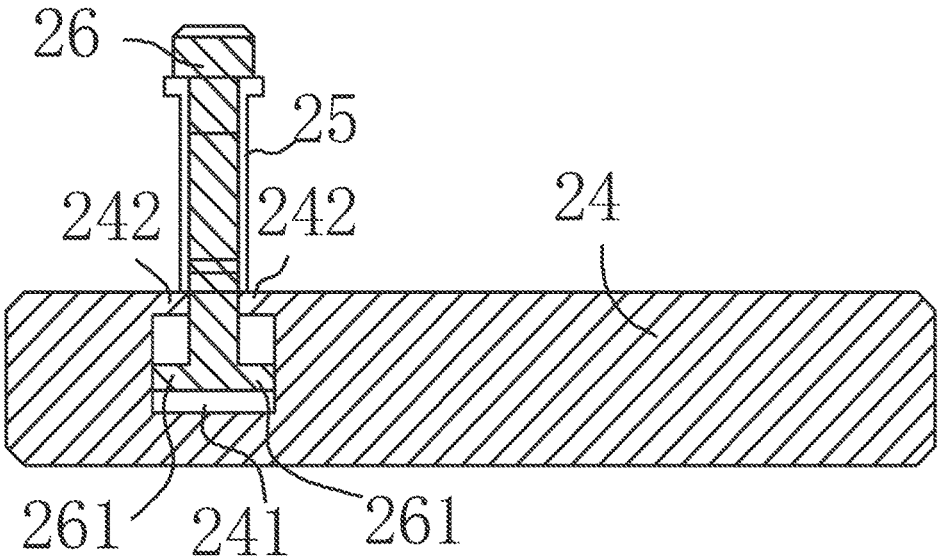
FIG. 11 is a view illustrating that a first stud is connected to a stripper plate according to an embodiment of the present application.

Referring to FIGS. 10 to 11, the upper die assembly 2 includes a stripper plate 24 and a first elastic element 25. The first elastic element 25 may be a spring, an elastic plate or the like. The stripper plate 24 is disposed below the second sub-die-plate 2123 and is a certain distance spaced from the second sub-die-plate 2123. One end of the first elastic element 25 is connected to the stripper plate 24, and another end of the first elastic element 25 is connected to the second sub-die-plate 2123. A first via 243 is formed on the stripper plate 24 in a direction in which the first cutter 22 moves. The first cutting edge portion 221 may move up and down within the first via 243. A bottom dead position of the first cutting edge portion 221 is located below the lower surface of the stripper plate 24. The bottom dead position is capable of preventing the first cutting edge portion 221 from continuing moving downward. The distance between the bottom dead position of the first cutting edge portion 221 and the stripper plate 24 can be set according to specific needs, and is able to at least cut the fin to be cut.

Referring to FIGS. 10 to 11, the upper die assembly 2 further includes a first stud 26. The upper end of the first stud 26 is fixedly connected to at least one of the first sub-die-plate 2121 or the second sub-die-plate 2123. The fixed connection mode may be welding or screwing. The stripper plate 24 is formed on a lower side of the second sub-die-plate 2123. One end of the first elastic element 25 is connected to the stripper plate 24 and another end of the first elastic element 25 is connected to at least one of the first sub-die-plate 2121 or the second sub-die-plate 2123. The first elastic element 25 is sleeved on the periphery of the first stud 26. The lower end of the first stud 26 is movably connected to the stripper plate 24. For example, a first stud hole 241 is formed on the stripper plate 24. First stops 242 are formed extending from a hole opening of the first stud hole 241 to the center axis the hole opening. Second stops 261 engaged with the first stops 242 are formed at the lower end of the first stud 26. The second stops 261 are located within the first stud hole 241. The lower end of the first stud 26 may move downward with respect to the first stud hole 241 to the bottom of the first stud hole 241. The lower end of the first stud 26 may move upward with respect to the first stud hole 241 until the first stops 242 abut against the second stops 261. That is, the stripper plate 24 may move up and down with respect to the second sub-die-plate 2123. Moreover, the first stops 242 and the second stops 261 stop the first stud 26 so that the operation stability of the stripper plate 24 can be increased.

Figure 5:
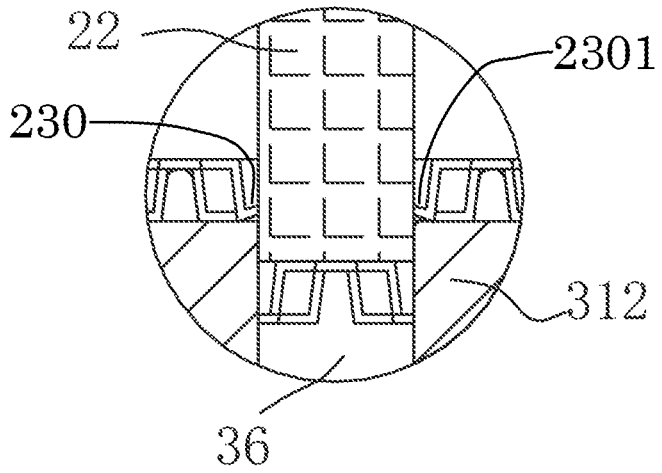
FIG. 5 is a partial enlarged view of part A1 of FIG. 4.

Referring to FIGS. 1 and 5, the lower die assembly 3 includes a lower die plate 31 and the upper die assembly 2 further includes a second stud 27. The top end of the second stud 27 is fixedly connected to the second upper die plate 212. A positioning hole 310 is formed on the lower die plate 31. The bottom end of the second stud 27 may reciprocate within the positioning hole 310 without detaching from the positioning hole 310. The second stud 27 is engaged with the positioning hole 310 so as to increase the movement stability of the second upper die plate 212, thereby improving the movement stability of the upper trimming blade and improving the flatness of the cut of the fin.

Based on the processing apparatus described in the preceding embodiment, the embodiment of the present application further provides a control method for the processing apparatus, as described below.

The upper die assembly 2 and the lower die assembly 3 are in a die opening state, a material (the fin to be cut) is fed to the upper end portion 313, and then the first driver is activated. The first driver drives the upper die plate mounting table 1 to move downward, the upper die plate mounting table 1 drives the upper die plate 21 to move downward, the first cutter 22 moves downward along with the upper die plate 21, the stripper plate 24 moves downward synchronously, when the stripper plate 24 moves to be in contact with the material, the upper die plate 21 continues moving downward under the action of the first driver, the second stops 261 move downward with respect to the first stops 242, the first elastic element 25 is compressed, the first cutting edge portion 221 starts to move downward along the first via 243, after the first cutting edge portion 221 moves a preset distance, the first cutting edge portion 221 is exposed out of the first via 243, when the first cutting edge portion 221 moves to the bottom dead position, the first cutting edge portion 221 and the second cutting edge portion 322 are interleaved and complete cutting the material, and the cutting waste falls in the blanking channel 36.

After the material cutting ends, the first driver drives the upper die plate mounting table 1 to move upward, the upper die plate mounting table 1 drives the upper die plate 21 to move upward, the upper die plate 21 drives the first cutter 22 to move upward, the second stops 261 move upward with respect to the first stops 242, the first elastic element 25 is stretched, the stripper plate 24 is stationary with respect to the upper end portion 313 under an elastic force of the first elastic element 25, when the first cutting edge portion 221 moves upward between an upper port of the first via 243 and a lower port of the first via 243, that is, the upper die assembly 2 and the lower die assembly 3 are in the die opening state, the first cutting edge portion 221 is located at the position of the first via 243, the first stops 242 and the second stops 261 are in contact and drive the stripper plate 24 to continue moving upward along with the upper die assembly 21. When the upper die assembly 21 moves to an initial position, i.e., a start position when the upper die assembly 2 and the lower die assembly 3 are in the die opening state, the movement stops.

Referring to FIG. 1, the upper die plate 21 further includes a first upper die plate 211 and a second upper die plate 212. The first upper die plate 211 is disposed above the second upper die plate 212. The second upper die plate 212 includes a first sub-die-plate 2121. Protrusions 2111 are formed on one of the first upper die plate 211 or the first sub-die-plate 2121, and recesses 2111 are formed on another of the first upper die plate 211 or the first sub-die-plate 2121, and each of the recesses is engage with a respective one of the protrusions 2111. In one embodiment, the protrusions 2111 are formed on the first upper die plate 211, and the recesses 2111 engaged with the protrusions 2111 are formed on the first sub-die-plate 2121. The first driver includes a first sub-driver 41 and the second sub-driver 42. The first sub-driver 41 includes a first motor. The first sub-driver 41 can drive the upper die plate mounting table 1 to move downward, and then drive the first upper die plate 211 to move downward. The second sub-driver 42 includes a second motor. The second sub-driver 42 can drive the stripper plate 24 to move upward.

In one embodiment, the first sub-driver 41 is connected to the upper die plate mounting table 1, and the second sub-driver 42 is connected to the stripper plate 24.

The fin is moved rightward a certain distance, causing the positioning protrusion 35 to be accommodated in the molding recess 71, and the above operation is continued to complete a next cutting.

The driving mechanism further includes a second driver 43. The second driver 43 includes a driver body 431 and a drive rod 432. The driver body 431 is connected to one end of the upper die plate mounting table 1. One end of the drive rod 432 is connected to the driver body 431, and another end of the drive rod 432 is connected to one end of the first upper die plate 211. The another end of the drive rod 432 can move left and right under the drive of the driver body 431 so that the first upper die plate 211 moves left and right with respect to the upper die plate mounting table 1. The driver body 431 may be a third motor.

When the protrusion 2111 is opposite to the recess 2122, the protrusion 2111 may extend into the recess 2122. That is, the protrusion 2111 and the recess 2122 are combined. Moreover, the first upper die plate 211 can move leftward with respect to the second upper die plate 212 so that the protrusion 2111 and the recess 2122 are separated; therefore, the protrusion 2111 is detached from the recess 2122. The bottom end of the protrusion 2111 abuts against the upper surface of the first upper die plate 211, pushing the second upper die plate 212 downward with respect to the first upper die plate 211 for a certain distance. When the first upper die plate 211 moves rightward with respect to the second upper die plate 212, the second upper die plate 212 moves upward under the action of the second driver 43 so that the protrusion 2111 is located within the recess 2122. That is, the protrusion 2111 and the recess 2122 are combined.

Referring to FIG. 1, the processing apparatus further includes a lower die plate mounting table 5 and a pad 6. The pad 6 is formed on the upper surface of the lower die plate mounting table 5. The lower die plate 31 is formed on the upper surface of the pad 6. The first driver further includes a second sub-driver 42. The second sub-driver 42 includes a second elastic element 421 and a drive arm 422. The upper end of the second elastic element 421 is connected to the bottom end of the drive arm 422. The bottom end of the second elastic element 421 is fixedly connected to the lower die plate mounting table 5. A second via is formed on the lower die plate 31 in the vertical direction. The drive arm 422 is partially located within the second via and can move up and down along the second via. The upper end of the drive arm 422 can expose out of the second via and abut against the lower surface of the stripper plate 24, and drive the stripper plate 24 to move up.

The processing apparatus can work with a fin former machine synchronously, improving the production efficiency and saving the cost.

Another embodiment of the control method for the processing equipment is as follows:

The upper die assembly 2 and the lower die assembly 3 are opened, a material (a fin to be cut) is fed to the upper end portion 313, and the first sub-driver 41 is activated. The first sub-driver 41 drives the upper die plate mounting table 1 to move downward, the upper die plate mounting table 1 drives the first upper die plate 211 to move downward, the first upper die plate 211 drives the second upper die plate 212 to move downward, the first cutter 22 moves downward along with the second upper die plate 212, and the stripper plate 24 moves downward synchronously under the action of the first elastic element 25. Moreover, the stripper plate 24 drives the drive arm 422 to move downward and the drive arm 422 compresses the second elastic element 421.

When the stripper plate 24 moves to be in contact with the fin to be cut, the first sub-driver 41 is turned off so that the upper die plate mounting table 1 is stationary with respect to the upper end portion 313. That is, the first upper die plate 211 is stationary with respect to the upper end portion 313 in a vertical direction, the first upper die plate 211 does not move up and down with respect to the upper end portion 313. The second sub-driver 43 is activated, the second sub-driver 43 drives the first upper die plate 211 to move leftward with respect to the second upper die plate 212 so as to separate the protrusion 2111 from the recess 2122, the protrusion 2111 is separated from the recess 2122 so as to drive the second upper die plate 212 to continue moving downward, and so that the first elastic element 25 is compressed, the first cutting edge portion 221 starts to move downward along the first via 243, after the first cutting edge portion 221 moves a preset distance, the first cutting edge portion 221 is exposed out of the first via 243, when the first cutting edge portion 221 moves to the bottom dead position, the protrusion 2111 is totally separated from the recess 2122, the first cutting edge portion 221 is interleaved with the second cutting edge portion 322 so as to complete cutting the material, and the waste material falls into the blanking channel 36.

After the material cutting ends, the second driver 43 drives the first upper die plate 211 to move rightward with respect to the second upper die plate 212, the first elastic element 25 is stretched, and the second upper die plate 212 moves upward under the elastic force of the first elastic element 25 so that the protrusion 2111 is engaged with the recess 2122, the second upper die plate 212 drives the first cutter 22 to move upward, the stripper plate 24 is stationary with respect to the upper end portion 313 under the elastic force of the first elastic element 25, when the first cutting edge portion 221 moves upward between the upper port of the first via 243 and the lower port of the first via 243, and when the upper die assembly 2 and the lower die assembly 3 are in the die opening state, the first cutting edge portion 221 is located at the position of the first via 243 and the second driver 43 is turned off.

After the second driver 43 is turned off, the first driver is turned on, and the first driver drives the upper die plate mounting table 1 to move upward. Moreover, the drive arm 422 pushes the stripper plate 24 upwards under the elastic force of the second elastic element 421 until the upper die assembly 2 and the lower die assembly 3 are in the die opening state.

Figure 7:
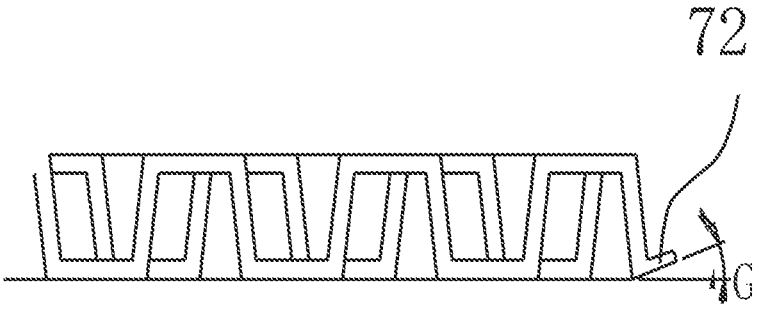
FIG. 7 is a view illustrating the structure of one end portion of a cut fin according to an embodiment of the present application.

The fin moves rightward a certain distance, causing the positioning protrusion 35 to be accommodated in the molding recess 71, and the above operation is continued to complete a next cutting. Referring to FIG. 7, the cut fin has a tilted edge portion 72. In this manner, the burrs protruding from the lower surface of the fin and generated during the cutting process, and the effect on the flatness of the lower surface of the fin are reduced so that the lower surface of the fin can be better attached to the plate of the heat exchanger during the mounting process, improving the welding quality of the fin and the plate of the heat exchanger, and thus improving the heat exchange efficiency and the service life of the heat exchanger.

In the control method for the processing apparatus provided by the embodiment of the present disclosure, the driving mechanism controls the die opening and closing of the upper die assembly and the lower die assembly, facilitating the operation and saving the time.

Figure 12:
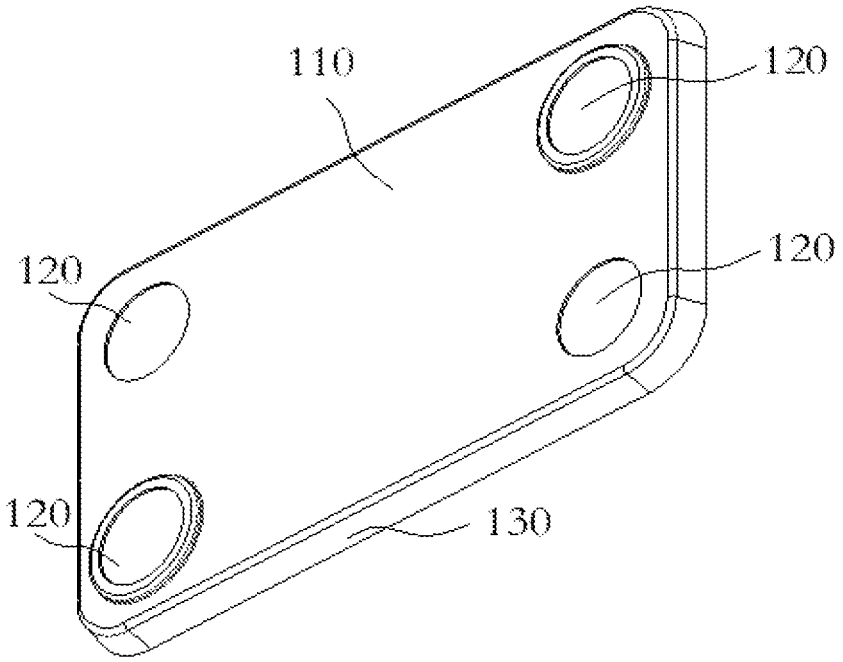
FIG. 12 is a view illustrating the structure of a first plate according to an embodiment of the present application.

An embodiment corresponding to a heat exchanger is as follows:

Referring to FIG. 12, the present application provides a heat exchanger. The heat exchanger includes a core. The core includes a first plate 10 and a second plate 30 disposed in stack. The first plate 10 and the second plate 30 are each includes four corner holes 120. The four corner holes 120 are disposed in stack so as to form a first hole channel, a second hole channel, a third hole channel and a fourth hole channel. The core further includes a first inter-plate channel and a second inter-plate channel. The first inter-plate channel is located between the first plate 10 and the second plate 30 adjacent to the first plate 10. The second inter-plate channel is located between the first plate 10 and another second plate 30 adjacent to the first plate 10. The first hole channel is communicated with the second hole channel by the first inter-plate channel. The third hole channel is communicated with the fourth hole channel by the second inter-plate channel.

The first plate 10 includes a first planar portion 110, and a flanging 130 disposed obliquely upward along the circumference of the first planar portion 110. The first planar portion 110 is substantially in the shape of a plane. The second plate 30 is substantially the same as the first plate 10. The second plate 30 includes a second planar portion 3001 and a flanging disposed obliquely upward along the circumference of the second planar portion 3001. The flanging 130 on the first plate 10 is welded to the flanging on the second plate 30.

Figure 13:
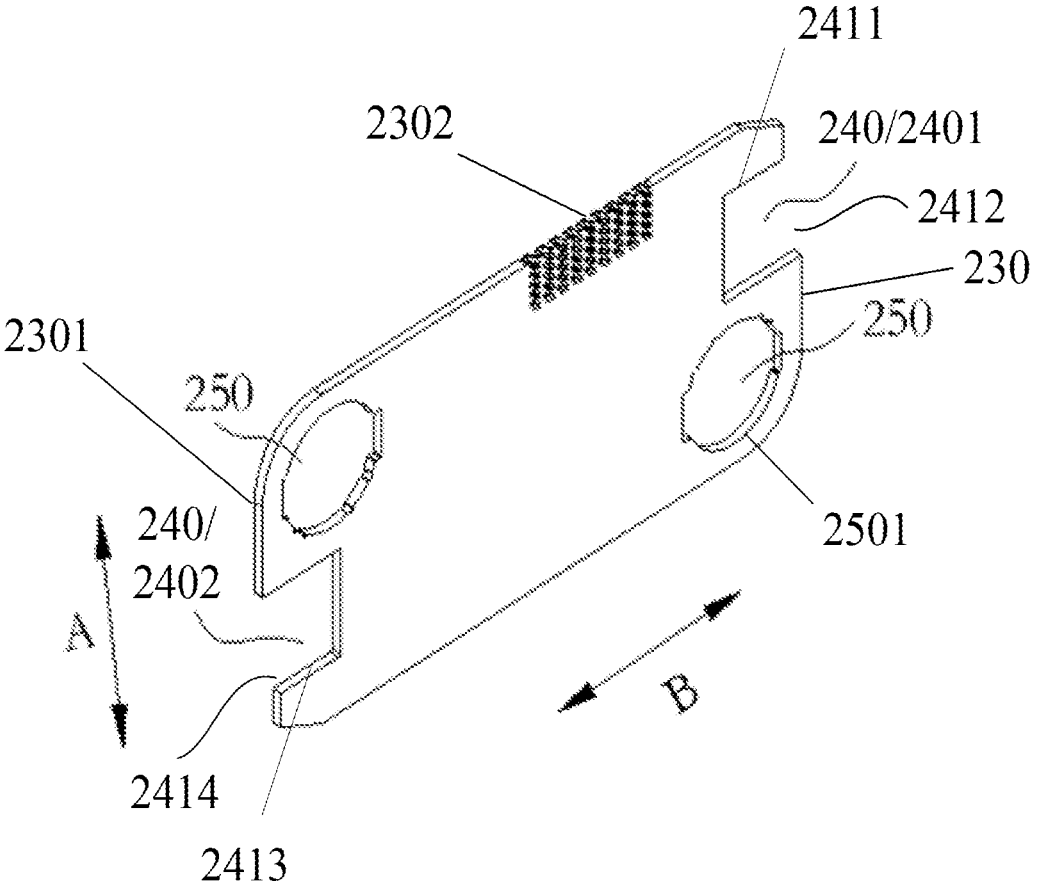
FIG. 13 is a view illustrating the structure of a fin according to an embodiment of the present application.

Referring to FIGS. 12 to 17, the core further includes fins 20. The fins 20 are disposed between the first plate 10 and the second plate 30. The fins 20 are located both in the first inter-plate channel and the second inter-plate channel. Each fin 20 includes multiple protrusion portions and multiple connection portions 220. The multiple protrusion portions and the multiple connection portions 220 are alternately disposed. That is, each connection portion 220 connects two adjacent protrusion portions. Each protrusion portion includes a first sidewall 2110, a top wall 2120, and a second sidewall 213. One end of the first sidewall 2110 is connected to one end of the top wall 2120. One end of the second sidewall 213 is connected to another end of the top wall 2120. Another end of the first sidewall 2110 is connected to one connection portion 220 adjacent to the first sidewall 2110, and another end of the second sidewall 213 is connected to another connection portion 220 adjacent to the second sidewall 213. Referring to FIG. 13, the width direction of the fin is defined as the direction corresponding to a two-way arrow A. In the width direction of the fin, two adjacent protrusion portions are disposed in dislocation, improving the turbulence effect and the heat exchange performance of the fin.

Figure 14:
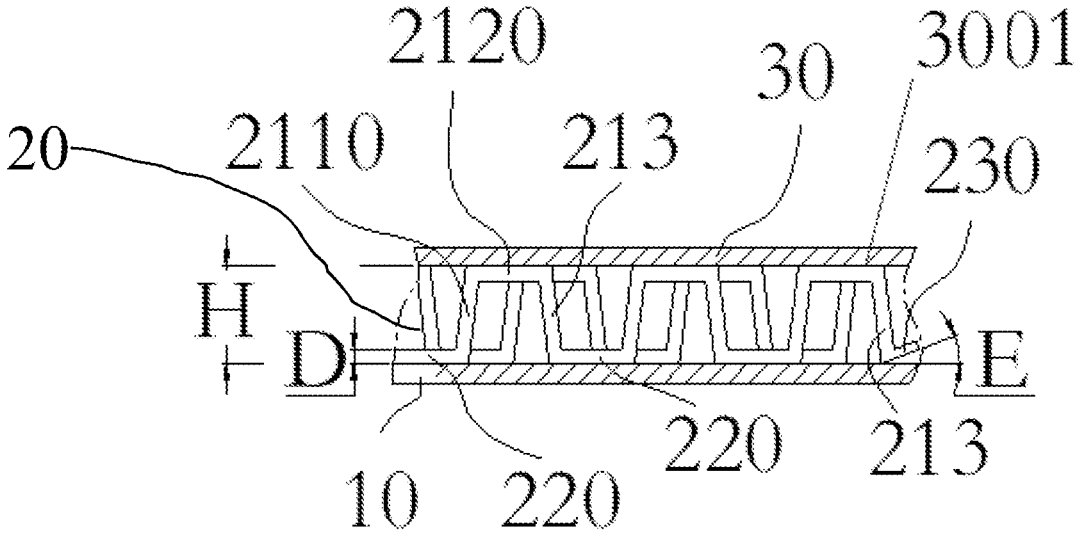
FIG. 14 is a partial view illustrating that a first edge portion is protruded from a first plate according to an embodiment of the present application.

Referring to FIGS. 13 to 14, the case where the fins 20 are located in the first inter-plate channel is used as an example. The connection portion 220 is welded to the first plate 10 and the top wall 2120 is welded to the second plate 30. Each fin 20 further includes a first edge portion 230. For example, in blanking, the plate after the protrusion portions are punched forms a raw fin plate. The fin plate may be cut at the connection portions 220 after being transversely cut for reaching the required fin length. In this manner, the cutting is easy and the cut fin has small deformation. The cut connection portion 220 on the fin forms the first edge portion 230. The first edge portion 230 is connected to the second sidewall 213. The first edge portion 230 is tilted so that the included angle is formed between the first edge portion 230 and the first plate 10. The fin 20 further includes a second edge portion 2301. The second edge portion 2301 is symmetrical with the first edge portion 230 based on the central axis of the fin 20. Referring to FIG. 13, the length direction of the fin 20 is defined as the direction of a two-way arrow B. The first edge portion 230 and the second edge portion 2301 are located on sides of the fin 20 along the width direction of the fin 20 respectively. That is, the first edge portion 230 and the second edge portion 2301 define the length of the fin 20. The second edge portion 2301 is connected to the first sidewall 2110. The second edge portion 2301 is tilted so that the included angle is formed between the second edge portion 2301 and the first plate 10. The included angle between the first edge portion 230 and the first planar portion 110 is E, and 15°≤E≤20°. The included angle between the second edge portion 2301 and the first planar portion 110 is E, and 15°≤E≤20°.

In the heat exchanger provided by the present application, the fin 20 includes the first edge portion 230. The first edge portion 230 is connected to the second sidewall 213. The first edge portion 230 is tilted over the first plate 10. The fin 20 further includes a second edge portion 2301. The second edge portion 2301 is connected to the first sidewall 2110. The second edge portion 2301 is tilted over the first plate 10. The first edge portion 230 and the second edge portion 2301 are located on sides of the fin 20 along the width direction of the fin 20 respectively, improving the welding yield between the fin and at least one of the first plate 10 or the second plate 30, and improving the heat exchange efficiency of the heat exchanger.

In one embodiment, the fins 20 may also be disposed in the second inter-plate channel.

Figure 15:
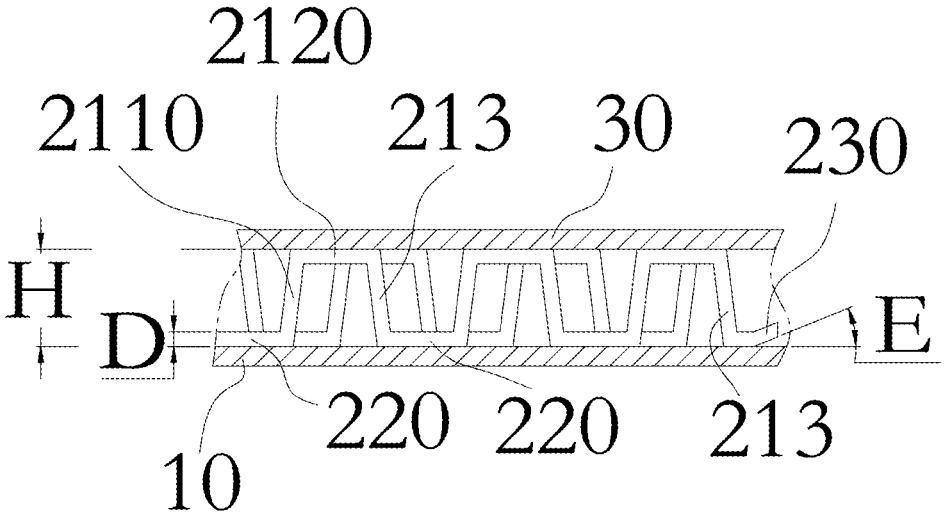
FIG. 15 is a partial view illustrating that a first edge portion is partially protruded from a first plate according to an embodiment of the present application.

Referring to FIG. 15, the connection portion 220 is welded to the first plate 10, and the top wall 2120 is welded to the second plate 30. The fin 20 includes a first edge portion 230. The end portion of the first edge portion 230 away from the second sidewall 213 is protruded from the first plate 10. That is, the first edge portion 230 is partially protruded with respect to the first plate 10. The gap is formed between the protrusion part and the first plate 10, saving the cost. The included angle between the protrusion part of the first edge portion 230 and the first plate 10 is E, and 15°≤E≤20°. The non-protrusion part of the first edge portion 230 with respect to the first plate 10 is welded to the first plate 10. The fin 20 further includes a second edge portion 2301. The second edge portion 2301 is connected to the first sidewall 2110. The end portion of the second edge portion 2301 away from the first sidewall 2110 is protruded from the first plate 10. The gap is formed between the protrusion part and the first plate 10, saving the cost. The included angle between the protrusion part of the second edge portion 230 with respect to the first planar portion 110 is E, and 15°≤E≤20°. The non-protrusion part of the second edge portion 230 with respect to the second plate 30 is welded to the first plate 10. The first edge portion 230 and the second edge portion 2301 are located on sides of the fin 20 along the width direction of the fin 20 respectively.

Figure 16:
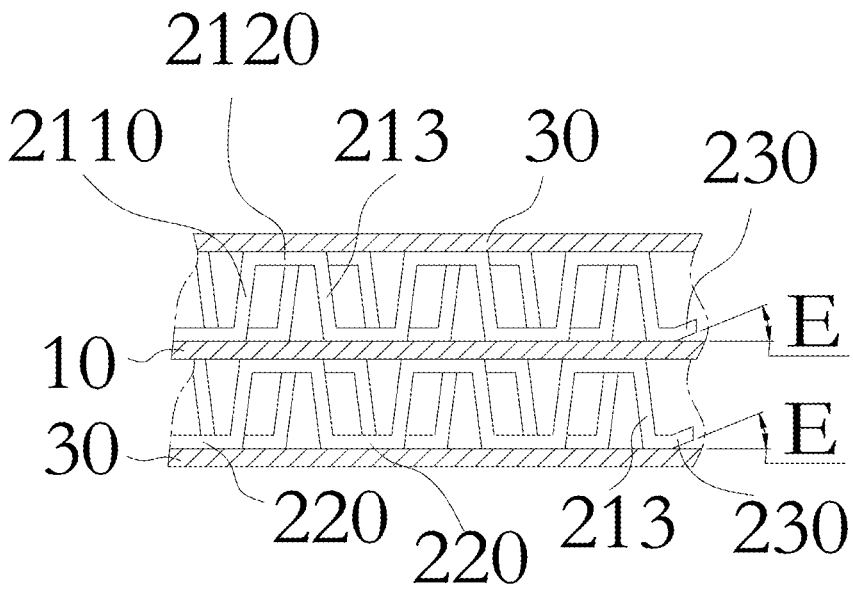
FIG. 16 is a partial view illustrating that fins are disposed in a first inter-plate channel and a second inter-plate channel according to an embodiment of the present application.

In one embodiment, referring to FIG. 16, the fins 20 are also disposed in the second inter-plate channel. The connection portion 220 is welded to the second plate 30. The top wall 2120 is welded to the first plate 10. The gap is formed between the protrusion part of the first edge portion 230 with respect to the second plate 30, and the second plate 30, saving the cost. The non-protrusion part of the first edge portion 230 with respect to the second plate 30 is welded to the second plate 30. The arrangement of the second edge portion 2301 is similar to the preceding arrangement and will not be repeated here again. The fins 20 are disposed both in the first inter-plate and the second inter-plate channel, improving the heat exchange efficiency of the heat exchanger.

Figure 17:
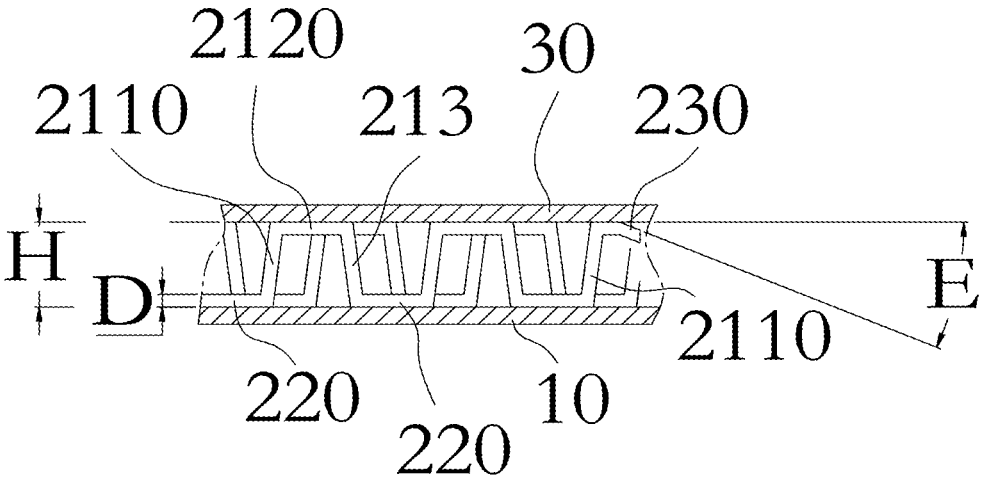
FIG. 17 is a partial view illustrating that a first edge portion is connected to a first sidewall according to an embodiment of the present application.

In one embodiment, referring to FIG. 17, the case where the fins 20 are located in the first inter-plate channel is used as an example. The connection portion 220 is welded to the first plate 10, and the top wall 2120 is welded to the second plate 30. Each fin 20 further includes a first edge portion 230. For example, in blanking, the raw fin plate. i.e., the plate after the protrusion portions are punched, is cut at the top wall after being transversely cut for reaching the fin length required by the customer. The cut top wall on the fin forms the first edge portion. The first edge portion 230 is connected to the first sidewall 2110. The first edge portion 230 or the end portion of the first edge portion 230 away from the first sidewall 2110 is protruded from the second plate 30. The included angle between the first edge portion 230 or the protrusion part of the first edge portion 230 with respect to the second plate 30 and the second planar portion 3001 is E, and 15°≤E≤20°. The fin 20 further includes a second edge portion 2301. The second edge portion 2301 is substantially the same as the first edge portion 230. The second edge portion 2301 is connected to the second sidewall 213. The second edge portion 2301 or the end portion of the second edge portion 2301 away from the second sidewall 213 is protruded from the second plate 30. The included angle between the second edge portion 2301 or the protrusion part of the second edge portion 2301 with respect to the second plate 30, and the second planar portion 3001 is E, and 15°≤E≤20°. The first edge portion 230 and the second edge portion 2301 are located on sides of the fin 20 along the width direction of the fin 20 respectively. The edge portion formed by cutting at the top wall 2120 is substantially the same as the edge portion formed by cutting at the connection portion 220 and will not be repeated here again.

In one embodiment, the fin 20 further includes a third edge portion 2302. The third edge portion 2302 is located on one side of the fin 20 along the length direction of the fin 20, and the third edge portion 2302 is substantially parallel to the length direction of the fin 20. The third edge portion 2302 is connected to the connection portion 220, and the third edge portion 2302 or the end portion of the third edge portion 2302 away from the connection portion 220 is protruded from the first plate 10; or the third edge portion 2302 is connected to the top wall 2120, and the third edge portion 2302 or the end portion of the third edge portion 2302 away from the top wall 2120 is protruded from the second plate 30. The third edge portion 2302 is substantially the same as at least one of the first edge portion 230 or the second edge portion 2301 and will not be repeated here again, improving the attachment of the fin 20 and at least one of the first plate 10 or the second plate 30.

Referring to FIGS. 13 and 14, the fin 20 further includes flow recesses 240 and the number of flow recesses 240 are two. The two flow recesses 240 are formed diagonally on the fin 20. One flow recess is defined as a first flow recess 2401 and the other flow recess is defined as a second flow recess 2402. The first edge portion 230 is formed on each sidewall 2411 of the first flow recess 2401. The first flow recess 2401 has three sidewalls 2411 and one opening 2412. The first edge portion 230 is formed on each sidewall 2411. The second edge portion 2301 is formed on each sidewall 2413 of the second flow recess 2402. The second flow recess 2402 has three sidewalls 2413 and one opening 2414. The second edge portion 2301 is formed on each sidewall 2413. The first edge portion 230 on both sides of the opening of one of the flow recess 240 or the second edge portion 2301 on both sides of the opening of the other flow recess 240 define the length of the fin 20.

The fin 20 also includes flow holes 250 and inner extension portions 2501 located on the inner wall of each flow holes 250. The number of flow holes 250 is two. The two flow holes 250 are formed diagonally on the fin 20. Each inner extension portion 2501 extends toward the center line of the flow hole 250, and the inner extension portion 2501 is connected to the first sidewall 2110. The inner extension portion 2501 or the end portion of the inner extension portion 2501 away from the first sidewall 2110 is protruded from the first plate 10 or the second plate 30. Alternatively, the inner extension portion 2501 is connected to the second sidewall 213, and the inner extension portion 2501 or the end portion of the inner extension portion 2501 away from the second sidewall 213 is protruded from the first plate 10. The formation and arrangement of the inner extension portion 2501 are substantially the same as the formation and arrangement of the preceding edge portions and will not be repeated here again.

Apparently, the flow recess 240 may be configured as the flow hole 250. The flow hole 250 may also be configured as the flow recess 240. The positions of the flow recess 240 and the flow hole 250 on the fin 20 can be set according to specific requirements.

Referring to FIGS. 14 to 17, the thickness of the connection portion 220 is D and 0.1 mm≤D≤0.5 mm so that the generation of the burrs on the cut surfaces of the first edge portion 230, the second edge portion 2301 and the third edge portion 2302 can be reduced when the raw material of the fin is cut into the fins 20, improving the welding yield of the fin 20 and the first plate 10, and thus improving the heat exchange efficiency of the heat exchanger.

Referring to FIGS. 14 to 17, the distance between the top wall 2120 and the connection portion 220 is H. That is, the thickness of the fin is H and 1.5 mm≤H≤10 mm so that the fin has good strength and heat exchange effect.

The present application provides a heat exchanger. A turbulence portion (not shown in the figure) such as a chevron-shaped wave plate or a dot wave plate is formed on the first planar portion 110 or the second planar portion 3001. The included angle between each of the first edge portion 230, the second edge portion 2301 and the third edge portion 2302, and the first planar portion 110 or the second planar portion 3001 is the included angle between each of the first edge portion 230, the second edge portion 2301 and the third edge portion 2302, and a plane that is substantially parallel to the first planar portion 110 or the second planar portion 3001.

In the heat exchanger provided by the embodiment of the present disclosure, the first edge portion 230 is connected to the second sidewall 213, and the first edge portion 230 or the end portion of the first edge portion 230 away from the second sidewall 213 is protruded from the first plate 10. Alternatively, the first edge portion 230 is connected to the first sidewall 2110, the first edge portion 230 or the end portion of the first edge portion 230 away from the first sidewall 2110 is protruded from the second plate 30, improving the attachment of the fin and at least one of the first plate 10 or the second plate 30, improving the welding yield of the fin and at least one of the first plate 10 or the second plate 30, and improving the heat exchange efficiency of the heat exchanger.

What is claimed is:

1. A processing apparatus, comprising:

an upper die assembly comprising a first cutter, wherein the first cutter comprises a first cutting edge portion;

a lower die assembly disposed opposite to the upper die assembly, wherein the lower die assembly comprises a second cutter and a lower die plate, the lower die plate has an upper end portion facing the upper die assembly, the second cutter is fixedly connected to the upper end portion and the second cutter comprises a second cutting edge portion higher than the upper end portion, wherein a distance between the second cutting edge portion and the upper end portion is denoted as H, and a value range of H is 0.1 mm≤H≤0.3 mm; and a driving mechanism configured to enable the upper die assembly to move with respect to the lower die assembly so that the first cutting edge portion is interleaved with the second cutting edge portion.

2. The processing apparatus of claim 1, wherein the second cutter further has a first slope portion in a direction facing the upper die assembly, one end of the first slope portion is connected to the upper end portion, and another end of the first slope portion is connected to the second cutting edge portion, and in a direction facing the second cutting edge portion, a vertical distance between the first slope portion and the upper end portion gradually increases, wherein an included angle between the first slope portion and the upper end portion is denoted as G, and a value range of G is 15°≤G≤20°.

3. The processing apparatus of claim 1, wherein the second cutter has a vertical portion, one end of the vertical portion is connected to the upper end portion, and another end of the vertical portion is connected to the second cutting edge portion, two second cutters are provided, each second cutter of the two second cutters comprises the second cutting edge portion and the vertical portion, a vertical portion of one second cutter of the two second cutters is disposed opposite to a vertical portion of another second cutter of the two second cutters, and the first cutter comprises two first cutting edge portions; and the driving mechanism is configured to be capable of driving the first cutter to move up and down so that one first cutting edge portion of the two first cutting edge portions is interleaved with a second cutting edge portion of one second cutter of the two second cutters, and another first cutting edge portion of the two first cutting edge portions is interleaved with a second cutting edge portion of another second cutter of the two second cutters.

4. The processing apparatus of claim 3, wherein a blanking channel is formed on the lower die plate, the lower die plate has a first sidewall portion extending downward from the vertical portion of the one second cutter of the two second cutters and further has a second sidewall portion extending downward from the vertical portion of the another second cutter of the two second cutters, and the blanking channel is formed between the first sidewall portion and the second sidewall portion.

5. The processing apparatus of claim 1, wherein the lower die assembly comprises a fourth cutter, the fourth cutter has a fourth cutting edge portion higher than the upper end portion, the fourth cutting edge portion is annular, the fourth cutter further comprises a second slope portion, one end of the second slope portion is connected to the upper end portion, and another end of the second slope portion is connected to the fourth cutting edge portion, and a vertical distance between the second slope portion and the upper end portion gradually increases in a direction facing the fourth cutting edge portion; and the driving mechanism is configured to be capable of driving the upper die assembly to move up and down so that the upper die assembly is interleaved with the fourth cutting edge portion.

6. The processing apparatus of claim 5, wherein the upper die assembly further comprises an upper die plate, one end of the first cutter away from the first cutting edge portion is connected to the upper die plate, and the driving mechanism comprises a first driver configured to be capable of driving the upper die plate to move up and down;

the upper die assembly further comprises a stripper plate and a first elastic element, the stripper plate is formed on one side of the upper die plate facing the second cutter, the stripper plate and the upper die plate are disposed at intervals, one end of the first elastic element is connected to the stripper plate, and another end of the first elastic element is connected to the upper die plate, and a first via is formed on the stripper plate in a direction in which the first cutter moves; and the first cutting edge portion is configured to move up and down within the first via, a bottom dead position of the first cutting edge portion is located below a lower surface of the stripper plate, and the bottom dead position is capable of preventing the first cutting edge portion from continuing moving downward.

7. The processing apparatus of claim 6, wherein the upper die plate comprises a first upper die plate and a second upper die plate, the first upper die plate is formed on one side of the second upper die plate away from the stripper plate, a protrusion is formed on one of the first upper die plate or the second upper die plate, a recess engaged with the protrusion is formed on another of the first upper die plate or the second upper die plate, and one end of the first cutter away from the first cutting edge portion is disposed in the second upper die plate;

the first driver comprises a first sub-driver and a second sub-driver, the first sub-driver is configured to drive the first upper die plate to move downward and the second sub-driver is configured to drive the stripper plate to move upward; and the driving mechanism further comprises a second driver configured to drive the first upper die plate to move left and right with respect to the second upper die plate so as to separate the protrusion from the recess or engage the protrusion with the recess.

8. The processing apparatus of claim 7, wherein the second upper die plate comprises a first sub-die-plate and a second sub-die-plate, a step recess is formed on the second sub-die-plate, a step portion is formed on one end of the first cutter away from the first cutting edge portion, the step portion is disposed within the step recess, the first sub-die-plate is formed on the second sub-die-plate and compresses the step portion, the protrusion or the recess is formed on one side of the first sub-die-plate opposite to the first upper die plate.

9. A control method for a processing apparatus, wherein the processing apparatus comprises an upper die assembly, a lower die assembly and a driving mechanism, the upper die assembly further comprises an upper die plate and a first cutter, the first cutter comprises a first cutting edge portion, one end of the first cutter away from the first cutting edge portion is connected to the upper die plate, the upper die assembly comprises a stripper plate and a first elastic element, the stripper plate is formed on one side of the upper die plate close to a second cutter, one end of the first elastic element is connected to the stripper plate, and another end of the first elastic element is connected to the upper die plate, a first via is formed on the stripper plate in a direction in which the first cutter moves, the lower die assembly is disposed opposite to the upper die assembly, the lower die assembly comprises the second cutter and a lower die plate, the lower die plate has an upper end portion facing the upper die assembly, the second cutter is fixed to the upper end portion, the second cutter comprises a second cutting edge portion higher than the upper end portion, and the driving mechanism comprises a first driver;

the control method for the processing apparatus comprises:

a step, in which a material is fed to the upper end portion, the first driver is activated, the first driver drives the upper die plate to move downward, the first cutter moves downward along with the upper die plate, the stripper plate moves downward synchronously, when the stripper plate moves to be in contact with the material, the lower die plate continues to move downward under an action of the first driver, the first elastic element is compressed, the first cutting edge portion starts to move downward along the first via, after the first cutting edge portion moves a preset distance, the first cutting edge portion is exposed out of the first via, and when the first cutting edge portion moves to a bottom dead position, the first cutting edge portion is interleaved with the second cutting edge portion so as to complete cutting the material; and a step, in which after the material cutting ends, the first driver drives the upper die plate to move upward, the upper die plate drives the first cutter to move upward, the first elastic element is stretched, the stripper plate is stationary with respect to the upper end portion under an elastic force of the first elastic element, when the first cutting edge portion moves upward between an upper port of the first via and a lower port of the first via, and the first driver drives the stripper plate to moves upward.

10. The control method for the processing apparatus of claim 9, wherein the upper die plate comprises a first upper die plate and a second upper die plate, the first upper die plate is formed on one side of the second upper die plate away from the stripper plate, a protrusion is formed on one of the first upper die plate or the second upper die plate, a recess engaged with the protrusion is formed on another of the first upper die plate or the second upper die plate, and one end of the first cutter away from the first cutting edge portion is disposed in the second upper die plate, the first driver comprises a first sub-driver and a second sub-driver, the first sub-driver is configured to drive the first upper die plate to move downward and the second sub-driver is configured to drive the stripper plate to move upward; and the driving mechanism further comprises a second driver configured to drive the first upper die plate to move left and right with respect to the second upper die plate, so as to separate the protrusion from the recess or to engage the protrusion with the recess;

the control method for the processing apparatus further comprises:

a step, in which the material is fed to the upper end portion, the first sub-driver is activated, the first sub-driver drives the first upper die plate to move downward, the first upper die plate drives the second upper die plate to move downward, the first cutter moves downward along with the second upper die plate, and the stripper plate moves downward synchronously;

a step, in which the first sub-driver is turned off when the stripper plate moves to be in contact with the material so that the first upper die plate is stationary with respect to the upper end portion in a vertical direction, the second sub-driver is activated, the second sub-driver drives the first upper die plate to move leftward with respect to the second upper die plate so as to separate the protrusion from the recess, the protrusion is separated from the recess so as to drive the second upper die plate to continue moving downward, so that the first elastic element is compressed, the first cutting edge portion starts to move downward along the first via, after the first cutting edge portion moves a preset distance, the first cutting edge portion is exposed out of the first via, and when the first cutting edge portion moves to the bottom dead position, the first cutting edge portion is interleaved with the second cutting edge portion so as to complete cutting the material; and a step, in which after the material cutting ends, the second driver drives the first upper die plate to move rightward with respect to the second upper die plate, the second upper die plate moves upward under the elastic force of the first elastic element so that the protrusion is engaged with the recess, the stripper plate is stationary with respect to the upper end portion under the elastic force of the first elastic element, when the first cutting edge portion moves upward between the upper port of the first via and the lower port of the first via, the second driver is turned off, the first sub-driver is activated, the first sub-driver drives the first upper die plate to move upward, and the second sub-driver drives the stripper plate to moves upward.

* * * * *